United States Patent [19]

Sonnenberg

[11] Patent Number: 5,065,194

[45] Date of Patent: Nov. 12, 1991

[54] PIEZO FILM CLEANER

[75] Inventor: Sven Sonnenberg, Rochester, N.Y.

[73] Assignee: Eastman Kodak Company, Rochester, N.Y.

[21] Appl. No.: 530,145

[22] Filed: May 29, 1990

[51] Int. Cl.[5] ..... G03G 21/00

[52] U.S. Cl. ..... 355/296; 310/323; 355/303

[58] Field of Search ..... 355/296, 297, 300, 303, 355/212; 15/1.51; 310/800, 323

[56] References Cited

U.S. PATENT DOCUMENTS

| | | | |
|---|---|---|---|
| 3,483,034 | 12/1964 | Ensminger | 134/1 |
| 3,617,123 | 11/1971 | Emerson | 355/301 |
| 3,832,580 | 8/1974 | Yamamuro et al. | 310/9.5 |
| 3,965,478 | 6/1976 | Schloemann | 346/74.1 |
| 4,007,982 | 2/1977 | Stange | 355/299 |
| 4,096,826 | 6/1978 | Stange | 355/300 |
| 4,111,545 | 9/1978 | Meltzer | 355/299 |
| 4,111,546 | 9/1978 | Maret | 355/297 |
| 4,142,192 | 2/1979 | Ochi | 346/153 |
| 4,542,564 | 9/1985 | Mount | 310/800 X |
| 4,797,689 | 1/1989 | Nanai | 346/76 PH |
| 4,875,070 | 10/1989 | Hattori | 355/299 |
| 4,918,488 | 4/1990 | Creveling et al. | 355/296 |

*Primary Examiner*—A. T. Grimley
*Assistant Examiner*—Nestor R. Ramirez
*Attorney, Agent, or Firm*—Tallam I. Nguti

[57] ABSTRACT

Apparatus for removing toner particles from a film photoconductor used in copiers, printers, and other electrostatographic devices. A piezo film is wrapped around a pliable material which is positioned around a rigid tubular member. The ends of the piezo material are clamped to the tubular member by special clamps which allow the piezo film to expand and contract radially when excited by an alternating power source. The film is positioned against the inside of the photoconductor to impart an agitating or vibrating motion which accelerates and loosens toner particles from the other side of the film. A charged roller is spaced from the photoconductor and attracts the agitated toner to the roller for deposit in a collection hopper.

6 Claims, 2 Drawing Sheets

FIG. 1
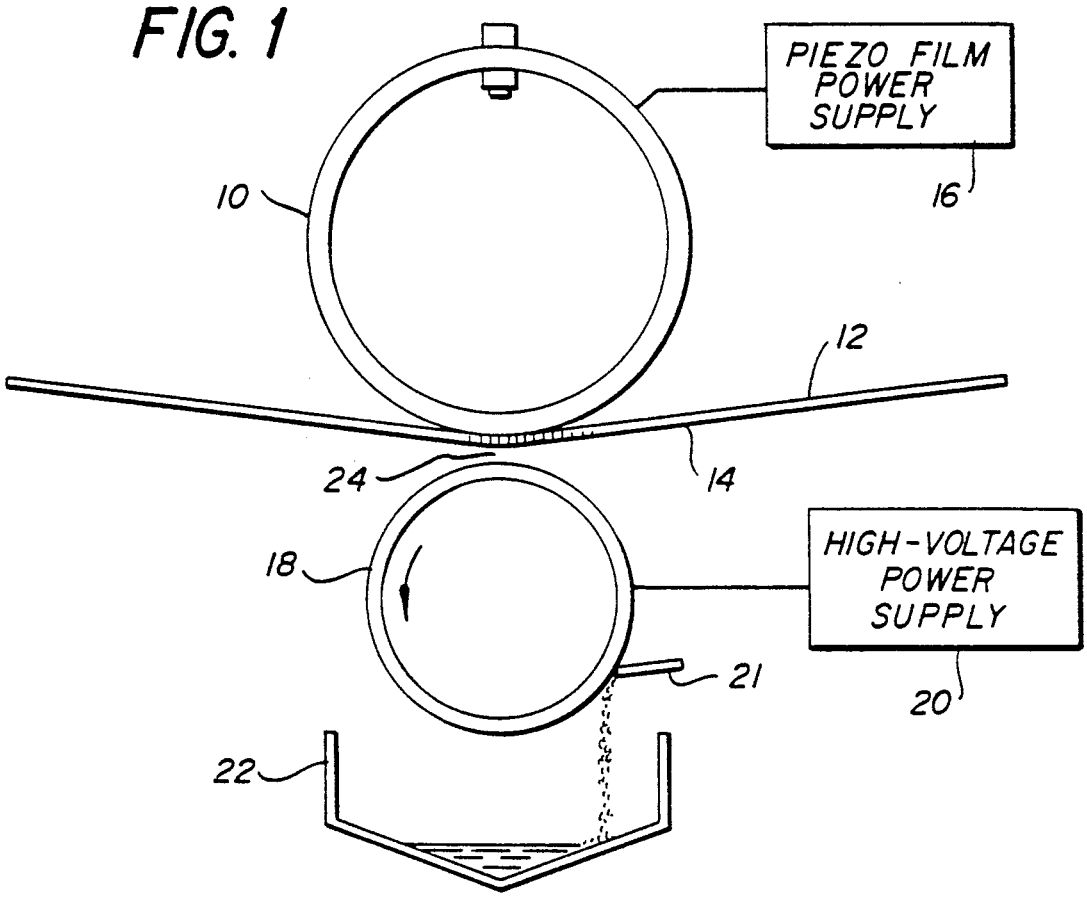
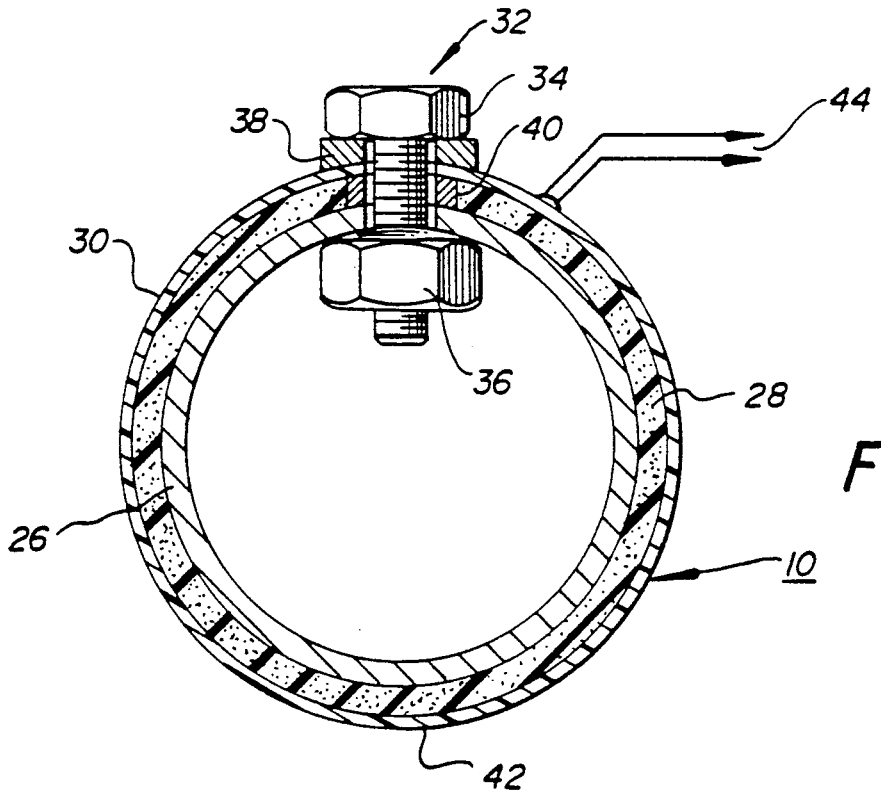
FIG. 2

PIEZO FILM CLEANER

BACKGROUND OF THE INVENTION

1. Field of the Invention

This invention relates, in general, to photocopying and, more specifically, to cleaning devices for removing residual toner from film photoconductors.

2. Description of the Prior Art

Cleaning toner from photosensitive members, or photoconductors, in copiers, printers, and like devices is one of the necessary functions usually performed in such apparatus. A toner cleaning station is usually located after the transfer of the developed image to the paper, transparency, or intermediate transfer member to remove any residual toner on the photoconductor after the transfer. Because of the many different types of machine configurations and processes used, there are many different types of toner cleaning devices which are constructed to offer certain advantages over other types of toner cleaning devices.

One main criteria in toner cleaning apparatus is to maintain adequate cleaning without scratching, scraping, marking, or otherwise degrading the surface of the photoconductor. One workable solution to the problem has been to keep the toner cleaning apparatus from touching the image side of the photoconductor. While this preserves the surface of the photoconductor and enhances its useful life, adequate cleaning with this type of system is sometimes difficult to achieve. Another requirement desired in cleaning apparatus is that it provide uniform cleaning action across the entire width of the photoconductor. With some types of cleaning systems, it is required that special arrangements of multiple cleaning devices be used across the photoconductor to provide the desired uniformity. This complicates the apparatus and can lead to manufacturing and service problems.

Other forms of cleaning apparatus have used a combination of cleaning devices which interact in the cleaning operation so that excessive force, mechanical or electrical, is not applied to the photoconductor. By using such combinations of devices, no one type of cleaning device significantly affects the surface of the photoconductor. This allows the photoconductor to be used for a large number of image transfer operations and machine life and economy are improved.

Film or web photoconductors are flexible and present special problems and solutions to film cleaning. U.S. Pat. No. 4,111,546, issued on Sept. 5, 1978, shows a cleaning system which, according to the patent text, can be used in film cleaning applications. This device uses a vibrating member on one side of the photoconductor and a brush cleaner-vacuum chamber system on the image side of the photoconductor. U.S. Pat. No. 3,965,478, issued on June 22, 1976, shows the use of a transducer on the inside of the photoconductor and a toner collection bin on the image side of the photoconductor to catch toner which falls from the photoconductor. Rather than removing toner after image transfer, this system is used to enhance the image quality before transfer by insuring that the proper toner particles are concentrated in the appropriate areas.

Therefore, it is desirable, and an object of this invention, to provide a non-destructive, uniform, cleaning device which is useful for removing residual toner from the image surface of a film photoconductor.

SUMMARY OF THE INVENTION

There is disclosed herein a new and useful cleaning device for removing toner from a photoconductive film or belt in copiers, printers, and like electrostatographic devices. An agitating or vibrating member is positioned on one side of the film and excited with electrical power. The vibrating member contacts the film across the complete width of the film and sets-up a vibrating motion in the film which loosens the toner particles on the other side of the film. Once accelerated and loosened, the residual toner particles on the film are attracted to a charged cylindrical roller which is positioned on the other or image side of the film. The attracted toner is then removed from the charged roller and deposited in a collection hopper. By using both agitating and attracting devices in a cooperative relationship on opposite sides of the film, the level of excitation and charging can be kept to a minimum for preserving the life of the photoconductor.

According to a specific embodiment of the invention, a piezo film is wrapped around a pliable material which is disposed around a tubular, or cylindrical, rigid support member. The piezo film is excited with an alternating voltage which causes the film to expand and contract and induce motion in the radial direction. A special clamping device is used to secure the piezo film around the pliable member and still allow radial movement when the film is properly excited. The piezo film rubs against the backside of the photoconductor film and causes toner on the image side of the film to be agitated and accelerated. This action decreases the force needed to cause the toner particles to move to a charged roller located near to but not touching the image side of the photoconductor.

BRIEF DESCRIPTION OF THE DRAWINGS

Further advantages and uses of this invention will become more apparent when considered in view of the following detailed description and drawings, in which:

FIG. 1 is a schematic illustration of the cleaning apparatus of this invention used in connection with a film photoconductor;

FIG. 2 is a cross-sectional view of a cylindrical piezo transducer constructed according to this invention;

DESCRIPTION OF THE PREFERRED EMBODIMENTS

Figure 3:
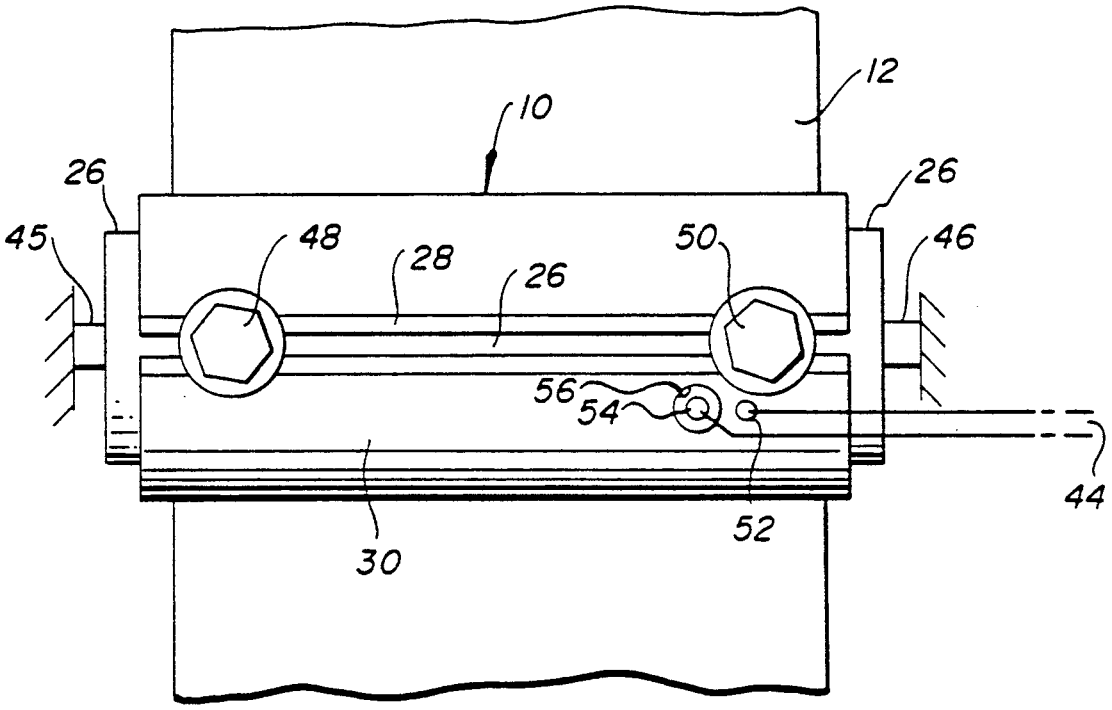
FIG. 3 is a top plan view of the piezo transducer.

Throughout the following description, similar reference characters refer to similar elements or members in all of the figures of the drawings.

Referring now to the drawings, and to FIG. 1 in particular, there is shown a film cleaning station constructed according to this invention. It is assumed, in this specific embodiment, that the cleaning station is located after the transfer process in an electrostatographic hard-copy output machine. According to FIG. 1, a tubular or cylindrical agitating member 10 is positioned against the inside portion of the film photoconductor or photosensitive member 12. Any toner particles to be removed from the photoconductor 12 would be located on the bottom side 14 of the film 12. A piezo film power supply 16 is used to excite the piezo film contained in the agitating or vibrating member 10, as will be described more completely in connection with FIG. 2. Since the film 12 is in contact with the member 10, the vibrations set up by the member 10 will be transmitted through the film 12 and produce an acceleration of the toner particles contained on side 14 of the film 12. This acceleration will help loosen the toner particles and aid in their removal from the film 12.

The charged roller 18 is connected to the high-voltage power supply 20 so that a suitable charge is developed on the roller 18 to attract the toner particles dislodged or loosened from the film 12 by the agitating action of member 10. Such particles are attracted to the roller 18 and deposited thereon for transfer toward the collection hopper 22 by the rotation of the roller 18. The skive blade 21 removes the toner attracted to the roller 18 and allows the toner to drop to the collection hopper 22, thus allowing a clean surface on the roller 18 to attract additional toner upon further rotation of the roller 18. Since there is a gap 24 between the roller 18 and the film 12, the image-bearing surface of the film 12, which is located on the bottom side 14, is not degraded by the cleaning action provided by the roller 18. In addition, the combination of loosening the toner particles by the member 10 and attracting the loosened particles by the roller 18 allows both devices to operate with less intensity and still provide adequate toner removal. In other words, if either device operated separately to remove toner, the agitating action of member 10 would need to be greater or the attraction force supplied by roller 18 would need to be greater. In some cases, the excessive forces needed to remove toner by a single member may eventually destroy or degrade the desirable properties of the photoconductor film 12.

FIG. 2 is a view, mostly in cross-section, of a cylindrical agitating member which could be used for the member 10 shown in FIG. 1. According to FIG. 2, the member includes the rigid tubular member 26, which can be constructed of steel, around which is disposed a pliable material 28. This material can be a rubber resilient foam or other material having suitable deforming characteristics. A piezo film 30 is wrapped around the pliable material 28 as indicated in FIG. 2 and clamped to the structure by the clamp assembly 32. This assembly includes the bolt 34, the nut 36, the washer 38, and the spacer 40. This secures the ends of the piezo film 30 to the rigid member 26 with the pliable material 28 located therebetween. In addition, the attachment is at the position on the member 26 which is farthest from the place where the piezo film 30 contacts the photoconductor film 12, which is approximately at location 42 shown in FIG. 2. The power leads 44 are connected to the piezo film 30 and are supplied with a suitable alternating voltage to excite or drive the piezo film 30. This causes the film 30 to contract and expand at the frequency of the applied voltage. This contraction and expansion causes the piezo film to impart a vibrating force to the photoconductor film which would touch the piezo film 30 at location 42. It is emphasized that the agitating or motion generating member 10 is constructed of a flat sheet of piezo film wrapped around a tubular member. This provides a long cylindrical source of vibrating force which can be used to uniformly agitate or vibrate the photoconductor 12 across the entire width of the photoconductor without the complexity of moving or multiple vibrating members.

FIG. 3 is a view of the agitating member 10 from the top indicating its positioning across the entire surface of the photoconductor film 12. The shafts 45 and 46 are connected to the rigid tubular assembly 26 and offer a means for attaching the member 10 to a stationary portion of the apparatus. The piezo film 30 is wrapped around the piable material 28 which is disposed over the rigid tubular member or assembly 26. Clamps 48 and 50 are comparable to the clamp 32 shown in FIG. 2, although other types and locations of clamps may be used within the contemplation of the invention.

The piezo film 30, as used in this specific embodiment, is a highly polar poly-vinylidene fluoride film covered on both sides with a metallic surface to create two electrodes on each side of the piezo film. The piezo activity of the film is created by applying opposite polarity voltages to the two electrodes of the film. Leads 44, shown in FIG. 3, provide acess to the two electrodes of the piezo film 30. One of the leads is attached to the outside electrode of the piezo film 30 at the terminal or spot 52. The other lead is attached to the inner electrode at the terminal or spot 54, which is accessible from the outside through an opening 56 in the outer electrode and the center piezo layer of the film 30.

Figure 4:
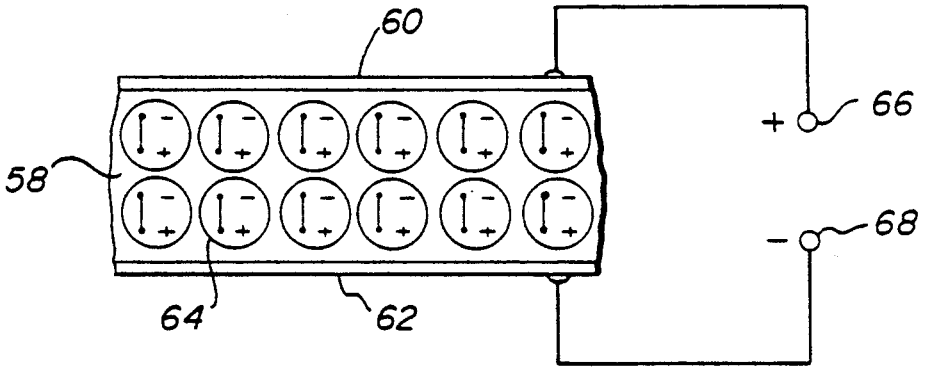
FIG. 4 is a diagram useful in describing the characteristics of piezo film.

A suitable material for use as the piezo film 30 is constructed by Pennwalt Corporation and marketed under the tradename KYNAR. FIG. 4 is a diagram illustrating the characteristics of such film. The inner layer 58 is positioned between the electrode surfaces 60 and 62. The inner layer 58 is poled during film manufacture to align the dipoles, such as dipole 64, in the direction indicated in FIG. 4. This is accomplished by exposing the polymer material comprising layer 58 to a high electric field at elevated temperatures. The level of piezo activity obtained by poling depends upon poling time, field strength, and temperature. When conducted properly, the poling process provides a permanent orientation of the molecular dipoles within the polymer. The poling potential for this process is applied to the terminals 66 and 68 with the polarities indicated to pole the molecular dipoles in the direction indicated. When the film is used in applications, a voltage applied to the electrodes of the piezo film causes the film to elongate or contract, depending upon the field polarity. When exposed to an alternating field, the field elongates and contracts as the field polarity changes.

By using the piezo film toner cleaning device of this invention, toner can be cleaned from a film photoconductor without appreciably degrading the performance of the photoconductor. The process exhibits uniformity by cleaning the photoconductor equally across the entire surface of the photoconductor. It is emphasized that numerous changes may be made in the above-described system without departing from the teachings of the invention. It is intended that all of the matter contained in the foregoing description, or shown in the accompanying drawings, shall be interpreted as illustrative rather than limiting.

I claim as my invention:

1. A cleaning apparatus for removing toner particles of a known polarity from the image-carrying side surface of a flexible photosensitive member in an electrophotographic copier or printer, the cleaning apparatus including:

(a) a container for holding toner particles removed from the image-carrying side surface of the flexible photosensitive member;

(b) a rotatable attracting roller connected to an electrical power source for charging said attracting roller to a polarity opposite that of the toner particles for attracting and collecting charged toner particles being removed from the image-carrying side surface of the flexible photosensitive member, said attracting roller being mounted at a point between said toner container and the image-carrying side surface of the flexible photosensitive member, and said attracting roller being spaced a small gap from such image-carrying side surface; and (c) a piezo film mounted in direct and continuous contact with the backside surface of the flexible photosensitive member, said piezo film being connected to a first electrical power source for piezoelectrically exciting said piezo film, and said piezo film mechanically directly agitating the flexible photosensitive member from said backside surface thereof, thereby causing toner charged particles from the image-carrying side surface to be thrown off therefrom.

2. The cleaning apparatus of claim 1 wherein said piezo film is sandwiched between said backside of said flexible photosensitive member and a pliable material.

3. The cleaning apparatus of claim 1 wherein said direct contact between the piezo film and the backside surface of the flexible member is uniform and continuous across the width of the flexible photosensitive member.

4. The cleaning apparatus of claim 1 including means for removing attracted toner particles from said attracting roller for collection into said container.

5. The cleaning apparatus of claim 2 wherein a rigid member retains said pliable material against said piezo film in contact with the backside surface of the flexible photosensitive member.

6. The cleaning apparatus of claim 5 wherein said piezo film, said pliable material and said rigid member have a generally cylindrical shape.

* * * * *